United States Patent [19]

Whitman

[11] Patent Number: 4,637,032

[45] Date of Patent: Jan. 13, 1987

[54] ROTARY SEAL FOR MOVABLE SHAFT TO ELIMINATE BREAKAWAY FRICTION

[75] Inventor: Richard E. Whitman, Ukiah, Calif.

[73] Assignee: Retech, Inc., Ukiah, Calif.

[21] Appl. No.: 682,861

[22] Filed: Dec. 18, 1984

[51] Int. Cl.[4] ..... H05B 7/10

[52] U.S. Cl. ..... 373/69; 277/59; 384/151

[58] Field of Search ..... 373/69, 94, 95, 96, 373/100, 99; 277/31, 61, 65, 81 R, 93, DIG. 8, 59; 384/15, 29, 489, 151–153

[56] References Cited

U.S. PATENT DOCUMENTS 3,384,777 5/1968 Sennewald et al. ..... 373/94 X 3,391,239 7/1968 Inouye ..... 373/69 X

*Primary Examiner*—Roy N. Envall, Jr.

*Attorney, Agent, or Firm*—Townsend and Townsend

[57] ABSTRACT

In apparatus of the type having a shaft which moves axially or is rotated, a rotary seal on the shaft for eliminating the breakaway friction between the shaft and its mount. The seal includes an inner sleeve surrounding the shaft and rotatable thereon, the sleeve having one or more seals on the inner surface thereof and in engagement with the shaft. The inner sleeve is supported at its ends on a pair of bearings which mount the shaft for movement. An outer sleeve fixed relative to a reference surrounds the inner sleeve and is received within a tubular member forming part of a fixed support. A power device coupled through a driver spur gear and a driven spur gear rotates the inner sleeve relative to the shaft and the outer sleeve as the shaft moves in a particular direction, such as axially or rotationally. The inner sleeve thereby eliminates the axial component of breakaway friction between the inner sleeve and the shaft. The inner sleeve can rotate in one direction or back and forth in opposite directions.

22 Claims, 4 Drawing Figures

ROTARY SEAL FOR MOVABLE SHAFT TO ELIMINATE BREAKAWAY FRICTION

This invention relates to improvements in the mounting of movable shafts and, more particularly, to a rotary seal for eliminating the breakaway friction of a shaft movable relative to a fixed mounting therefor.

BACKGROUND OF THE INVENTION

In a number of industrial processes carried out under vacuum or in a controlled atmosphere, it is desirable to measure the weight of an object located inside the process chamber and fastened to a movable shaft which passes through a seal to support means located outside the chamber. Friction at the seal between the shaft and the chamber leads to serious errors in weight measurement.

One such industrial process where the need for accurate weight determination is particularly acute is in vacuum consumable electrode arc melting. In a vacuum arc remelt process, an electrode fastened to the end of an axially movable shaft is progressively melted by an arc in a vacuum region for the purpose of driving off impurities in the material of the electrode. This is done several times to purify the material of the electrode and each time it is done, the electrode is shifted by the axially movable shaft within a housing which is evacuated and within which the arc occurs.

To monitor the amount of electrode left on the end of the shaft as the arc melts the electrode, the shaft has a sensor associated with it. This sensor is a load cell which measures the apparent weight of the electrode and shaft. The apparent weight may differ from the actual weight due to the existence of friction at the seal needed to preserve the vacuum or controlled atmosphere within the chamber. The breakaway seal friction in commercial vacuum arc furnaces may be as much as several hundred pounds. By reducing or substantially eliminating the axial component of frictional force associated with the seal between the shaft and the chamber, the apparent weight can be made more nearly equal to the actual weight of the electrode. The present invention as hereinafter described is directed to the elimination of such breakaway friction to thereby reliably provide a more accurate measure of the apparent weight of the electrode.

SUMMARY OF THE INVENTION

The present invention is directed to a rotary seal assembly which is rotatably mounted on a movable shaft to eliminate the axial component of the force associated with the seal between the shaft and its mount as the shaft moves relative to its mount. To this end, the rotary seal assembly of the present invention includes an inner sleeve having one or more seals on the inner surface thereof in engagement with the shaft. The assembly is provided with a power device which rotates the inner sleeve about the shaft as the shaft moves. The inner sleeve is received in an outer sleeve carried by a tubular member forming a part of the chamber. One or more O-rings can be provided between the inner and outer sleeves so that the rotary seal of the present invention can be suitable for pressurized systems, such as an apparatus for performing a vacuum arc remelt process.

The primary object of the present invention is to provide an improved seal for a movable shaft of an apparatus in which the shaft is movable either axially or rotationally or both wherein the seal rotates on the shaft and thereby eliminates the axial component of friction associated with the seal between the shaft and its mount to permit calculations of parameters, such as the weight of an object on the shaft, more accurately than has been possible heretofore.

Another object of the present invention is to provide an apparatus for performing a vacuum arc remelt process wherein an axially movable shaft has an electrode on one end thereof in a vacuum while a rotary seal is mounted on the outer surface of the shaft in sealing relationship thereto to eliminate breakaway friction and to permit the apparent weight of the electrode to be calculated accurately notwithstanding the progressive melting of the electrode in an arc in a vacuum zone inside the chamber, sealed from the atmosphere by the rotary seal assembly.

Other objects of this invention will become apparent as the following specification progresses, reference being had to the accompanying drawings for an illustration of the invention.

IN THE DRAWINGS

Figure 1:
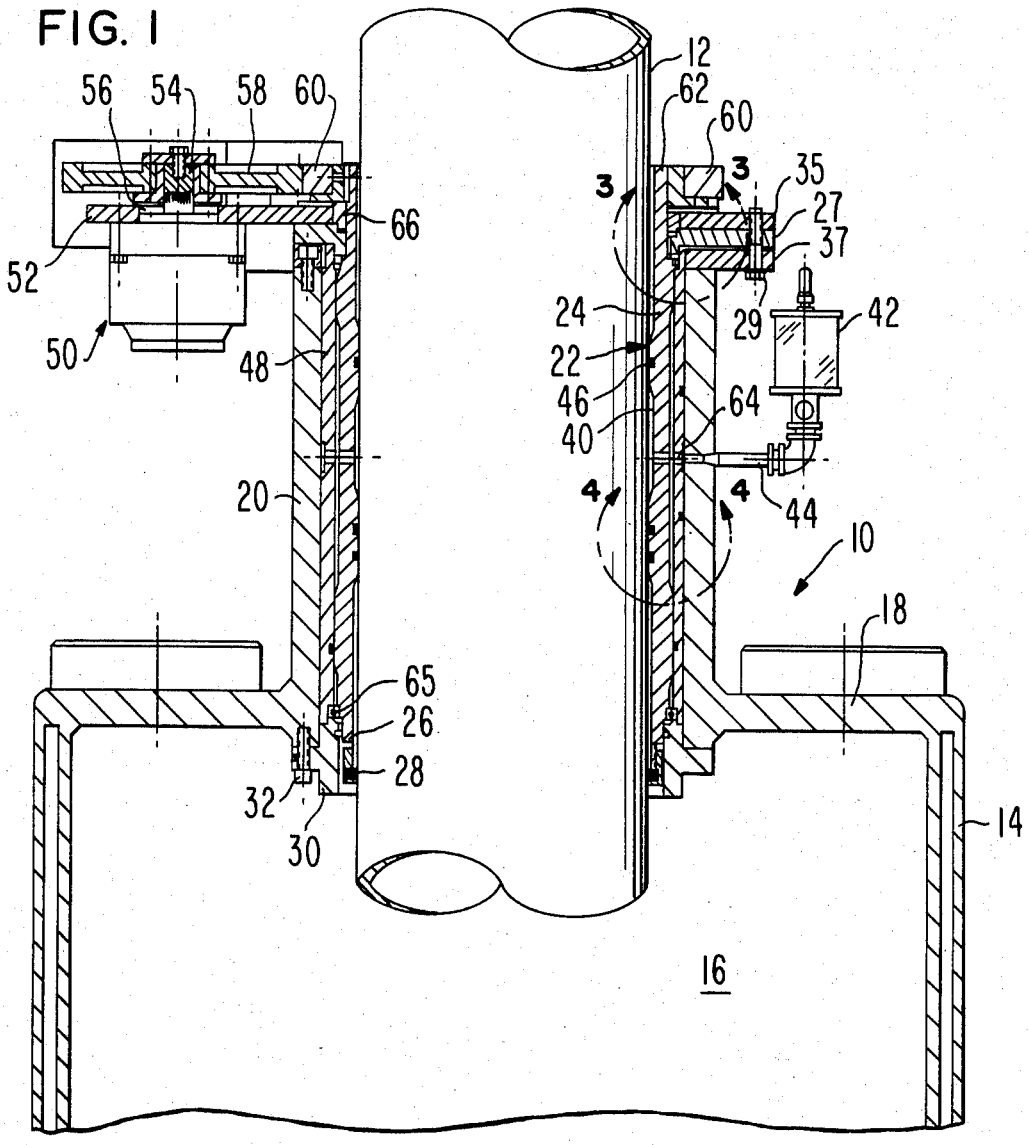
FIG. 1 is a vertical section through a furnace ram assembly illustrating the way in which the rotary seal of the present invention is used to eliminate breakaway friction.

The rotary seal assembly of the present invention is shown, for purposes of illustration, as part of a furnace ram apparatus 10 of the type having a downwardly movable shaft 12 (FIG. 1) having an electrode (not shown) on the lower end thereof. Melting of the electrode occurs to provide a molten mass of the material from which the electrode is made. This melting of the electrode is done for the purpose typically of purifying the metal. To this end, the electrode is melted several different times to drive off impurities by way of a vacuum system. Such a technique is called a vacuum arc remelt (VAR) process. However, it is to be understood that the rotary seal of the present invention is not limited to this application but can be used in apparatus for performing other processes as well. While the vacuum arc remelt process relates to melting of an electrode on an axially shiftable shaft in a vacuum, the rotary seal assembly of the present invention could also be used on a rotatable shaft and/or in a pressure system where positive fluid pressures are used or in a chamber where atmosphere control (e.g., pure argon or pure nitrogen, etc.) is maintained at substantially atmospheric pressure.

Apparatus 10 further includes a housing 14 into which shaft 12 extends. Housing 14 has an interior space 16 which, when used in a vacuum arc remelt process, is evacuated so that the melting of the electrode on the lower end of shaft 12 is accomplished in a vacuum to assist in driving off impurities existing in the material of the electrode at the time of the melting.

Housing 14 has an upper or top wall 18 to which a central, outer tubular member 20 is secured, tubular member 20 extending upwardly from and being integral with top wall 18 so as to form a central hole in the top wall 18 to permit shaft 12 to be located and to be moved downwardly into the housing. Generally, the shaft 12 moves downwardly under the influence of a drive means (not shown) outside the housing as the electrode is progressively melted.

The rotary seal assembly of the present invention is broadly denoted by the numeral 22 and includes an inner sleeve 24 surrounding and adjacent to and in sliding engagement with the outer surface of shaft 12. Inner sleeve 24 has a lower end 26 provided with a wiper element 28 surrounded by a lower bearing retainer 30 secured by bolts 32 to the underside of top wall 18. Lower bearing 65 supports the lower end 26 of inner sleeve 24 for rotation relative both to shaft 12 and outer sleeve 48.

The upper end of sleeve 24 is rotatably held in place by an upper bearing 66 which is secured by upper bearing retainer 27 which is secured by bolts 29 (FIG. 1) to and between a mounting plate 35 and an adapter plate 37, the adapter plate 37 being secured by a fastening means (not shown) to the upper end of tubular member 20. Inner sleeve 24 is rotatable relative to lower bearing retainer 30 and upper bearing retainer 27 and is also rotatable relative to shaft 12 which normally, in the particular application described above with respect to the vacuum arc remelt process, shifts axially downwardly. However, the rotary seal assembly of the present invention could be used in an application in which shaft 12 is rotational alone or in combination with axial movement.

Figure 4:
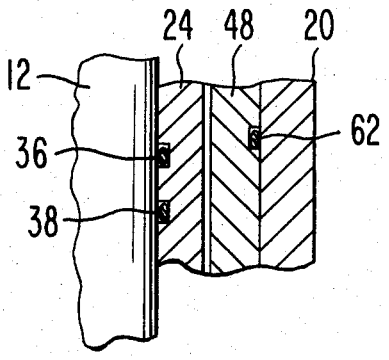
FIG. 4 is an enlarged, fragmentary cross sectional view of the structure within the circular line 4—4 of FIG. 1.

The interface between the outer surface of shaft 12 and the inner surface of inner sleeve 24 is provided with one or more seals, such as O-ring seals 36 and 38 as shown in FIG. 4. Seals 36 and 38 are disposed in annular grooves in the inner surface of inner sleeve 24. Generally, seals 36 and 38 will rotate with inner sleeve 24. This is assured in the case of an O-ring seal by making the inner diameter of each seal slightly larger than the diameter of the shaft 12 and compressing the seal on its outer diameter by inner sleeve 24 to put contact of the seal on the outer surface of the shaft. This will assure that the seal will then rotate with sleeve 24. The same principle applies if shaft 12 is rotatable.

As shown in FIG. 1, an annular space 40 can be provided between the outer surface of shaft 12 and the inner surface of sleeve 24. The purpose of this space is to receive a lubricant, such as vacuum pump oil, from a reservoir 42 by way of a tube 44 which extends through structure exteriorly of inner sleeve 24 as hereinafter described. Also, while FIG. 4 shows a pair of spaced O-ring seals 36 and 38, there could be other such seals 46 at other locations along the length of sleeve 24.

An outer sleeve 48 is in surrounding relationship to sleeve 24 and is fixed relative to tubular member 20 secured and extending upwardly from housing top wall 18. Inner sleeve 24 rotates within and relative to outer sleeve 48, sleeve 48 being coupled to adaptor plate 37 so as to be fixed relative to tubular member 20. The lower end of outer sleeve 48 is supported on lower bearing 65. Outer sleeve 48 in this illustration is made from an insulating material such as Micarta. The function of this sleeve is to maintain electrical isolation between the shaft, which is electrically "hot" and the chamber wall 20, which is electrically at ground potential.

Figure 3:
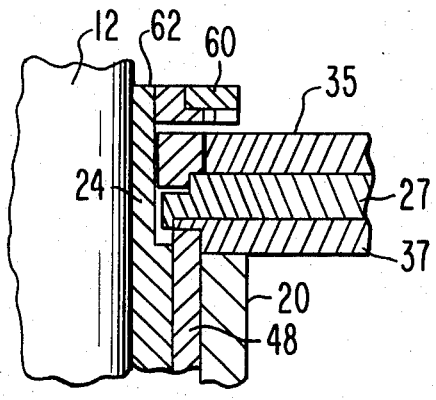
FIG. 3 is an enlarged, fragmentary cross sectional view of the structure within the circular line 3—3 of FIG. 1.

Inner sleeve 24 is coupled to a power actuated device 50 secured to and depending from an extension 52 of mounting plate 35 as shown in FIG. 1. Power device 50 can be of any suitable construction. For purposes of illustration, it comprises a hydraulic or pneumatic motor having a drive shaft 54 extending through an opening 56 in plate extension 52. The outer end of drive shaft 54 is coupled to a first gear 58 which is in mesh with a second gear 60 secured by a key adjacent to and surrounding the upper end 61 of inner sleeve 24 as shown in FIGS. 1 and 3. As used herein, gears include spur gears and other mechanical coupling means including a chain and sprocket assembly.

Figure 2:
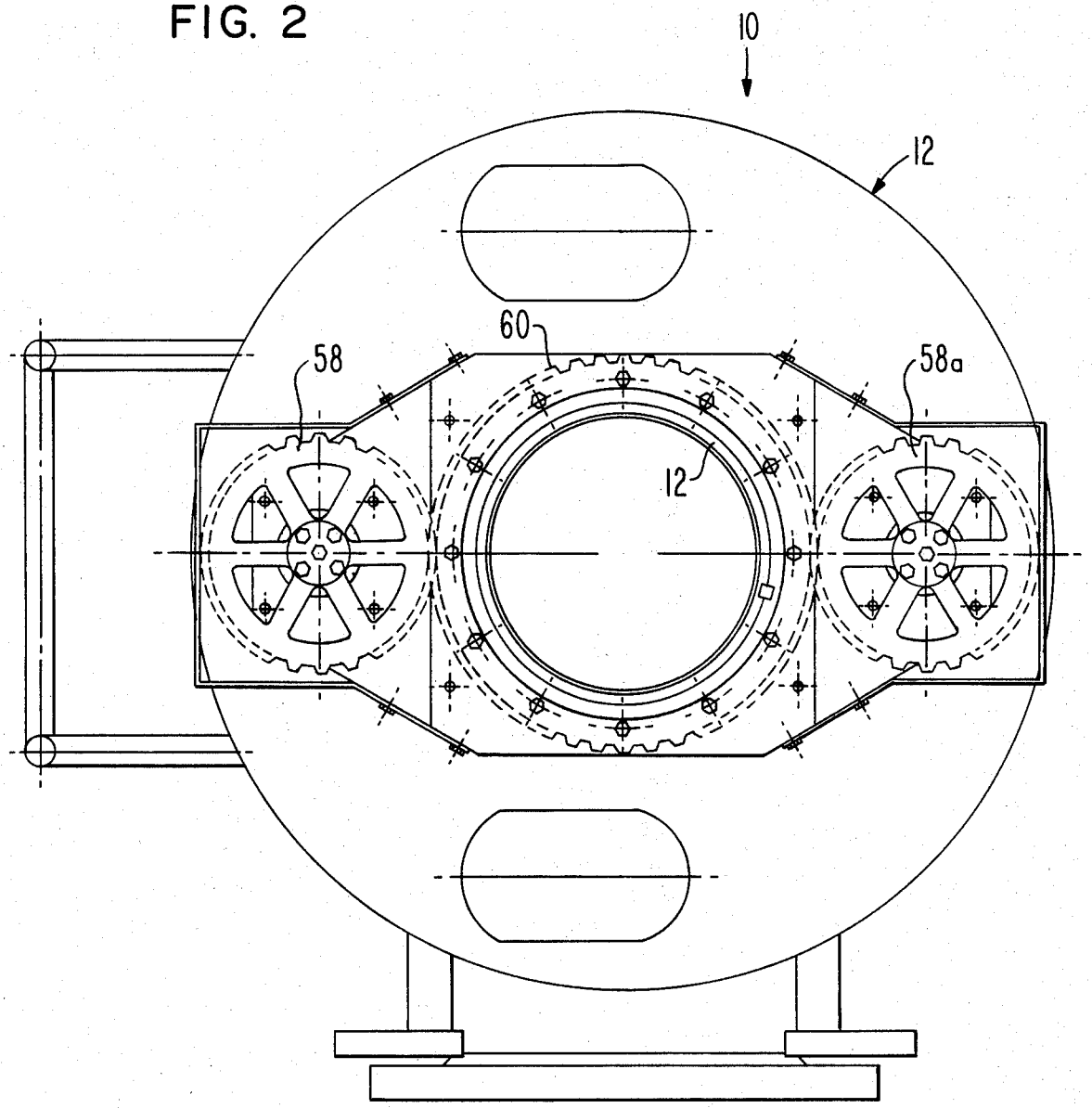
FIG. 2 is a top plan view of the ram assembly, showing part of the drive means for the rotary seal.

While a single actuator 50 is suitable for causing rotation of inner sleeve 24 relative to shaft 12, it is possible to have a second power device 50 (not shown) for driving another gear 58*a* in FIG. 2, gear 58*a* being diametrically opposed to gear 60 and in mesh with gear 58 for rotating gear 60 in the same direction in which the gear 60 is rotated by gear 58.

Outer sleeve 48 has one or more seals such as O-rings 62 in sealing relationship to the inner surface of tubular member 20 as shown in FIG. 4. Each O-ring 62 is in a groove in the outer surface of outer sleeve 48. Also, sleeve 48 and tubular member 20 have a passage 64 (FIG. 1) for receiving lubricant from reservoir 42 and directing the lubricant into the annular space 40 surrounding shaft 12 on the inner surface of inner sleeve 24.

In operation, shaft 12 progressively moves generally downwardly under the influence of a drive means (not shown) coupled to the shaft. This drive means feeds the electrode on the lower end of the shaft toward a zone in which an electrical arc is struck. As the shaft 12 moves downwardly, power device 50 will have been actuated to rotate inner sleeve 24 relative to outer sleeve 48 and shaft 12. This eliminates the breakaway friction of the seals between sleeve 24 and shaft 12 and permits a more accurate measurement to be made of the apparent weight of the electrode on the lower end of the shaft so as to provide a measure of how much of the electrode is left during a vacuum arc remelt process.

The inner sleeve 24 can rotate in one direction at a given rate depending upon the construction and operation of power device 50. Typically, the inner sleeve rotates at a speed of 3 to 5 revolutions per minute. However, it could be rotated at a different speed, if desired. Furthermore, inner sleeve 24 could rotate back and forth through a given arc rather than rotating in one direction only. The power device 50 will determine the speed of rotation and the direction of rotation of the inner sleeve relative to the shaft. In this way, the breakaway friction is not allowed to be established as shaft 12 moves axially relative to housing 14. During the rotation of inner sleeve 24, O-ring seals 36 and 38 ordinarily rotate with sleeve 24.

Measurements have shown that the axial component of seal friction is reduced by a factor of 10 to 100 or even more by initiating rotational motion as in the instant invention.

I claim:

1. In apparatus having a shaft movable with respect to a chamber having a fixed member, a rotary seal assembly comprising:

a normally vertical sleeve having first seal means on the inner surface thereof at spaced locations thereon for engagement at said locations with the outer surface of the shaft, and second seal means on the outer surface of the sleeve for engagement with a surface adapted to be fixed with respect to the member;

bearing means coupled with the sleeve at the upper and lower ends thereof for shiftably mounting the sleeve on said support for movement relative to the member and the shaft to allow the sleeve to move relative to the shaft as the shaft moves relative to said fixed member; and means carried by said mounting means and coupled with the sleeve for shifting the sleeve relative to the member and the shaft.

2. In apparatus as set forth in claim 1, wherein the sleeve has an inner, annular groove at each of said locations on the inner surface thereof, there being an O-ring in each groove defining said seal means.

3. In apparatus as set forth in claim 2, wherein the inner diameter of O-ring is greater than the outer diameter of the shaft and the sleeve is operable to compress O-ring onto the shaft, whereby O-ring will move with the sleeve relative to the shaft.

4. In apparatus as set forth in claim 1, wherein said mounting means includes a tubular member rotatably receiving the sleeve and adapted to rotatably receive the shaft, said shifting means including a power device carried by the tubular member and coupled with the sleeve.

5. In apparatus as set forth in claim 4, wherein said power device includes a fluid actuator.

6. In apparatus as set forth in claim 4, wherein said actuator includes a drive motor having a drive shaft, there being a first gear secured to the sleeve, and a second gear coupling the drive shaft of the motor with the first gear.

7. In apparatus as set forth in claim 4, wherein said power device includes a drive motor having a drive shaft, and a chain and sprocket assembly coupling the drive shaft with the sleeve.

8. In apparatus as set forth in claim 4, wherein said power device includes a drive motor operable to rotate the sleeve in one direction.

9. In apparatus as set forth in claim 4, wherein said power device includes drive means operable to rotate the sleeve in opposite directions.

10. In apparatus as set forth in claim 1, wherein is included means coupled with said mounting means and the sleeve for directing a lubricant to the interface between the sleeve and the shaft.

11. In vacuum arc remelt apparatus:

a movable shaft;

a vacuum housing having a fixed tubular member extending upwardly therefrom, said shaft shiftably extending through at least a portion of said member and into the housing; and a rotary seal assembly carried by said member, said assembly including a sleeve, means coupled with the sleeve for shiftably mounting the sleeve on the member in engaging relationship to the shaft at spaced locations thereon to allow the sleeve to rotate relative to the shaft as the shaft moves relative to the housing, and means carried by said mounting means and coupled with the sleeve for rotating the sleeve relative to the shaft.

12. In apparatus as set forth in claim 11, wherein the sleeve has seal means on the inner surface thereof for engagement with the outer surface of the shaft.

13. In apparatus as set forth in claim 12, wherein the sleeve has an inner, annular groove on the inner surface thereof at each of said locations, there being an O-ring in each groove defining said seal means.

14. In apparatus as set forth in claim 13, wherein the inner diameter of O-ring is greater than the outer diameter of the shaft and the sleeve is operable to compress O-ring onto the shaft, whereby O-ring will rotate with the sleeve relative to the shaft.

15. In apparatus as set forth in claim 11, wherein said mounting means includes a tubular member rotatably receiving the sleeve and adapted to rotatably receive the shaft, said rotating means including a power device carried by the tubular member and coupled with the sleeve.

16. In apparatus as set forth in claim 15, wherein said power device includes a fluid actuator.

17. In apparatus as set forth in claim 15, wherein said actuator includes a drive motor having a drive shaft, there being a first gear secured to the sleeve, and a second gear coupling the drive shaft of the motor with the first gear.

18. In apparatus as set forth in claim 15, wherein said power device includes a drive motor having a drive shaft, and a chain and sprocket assembly coupling the drive shaft with the sleeve.

19. In apparatus as set forth in claim 15, wherein said power device includes a drive motor operable to rotate the sleeve in one direction.

20. In apparatus as set forth in claim 15, wherein said power device includes a drive motor operable to rotate the sleeve in opposite directions.

21. In apparatus as set forth in claim 11, wherein is included means coupled with said mounting means and the sleeve for directing a lubricant to the interface between the sleeve and the shaft.

22. In an arc remelting process carried out in a chamber:

holding a shaft against lateral movement at a number of spaced locations on the shaft as the shaft is advanced in a downward direction;

melting an electrode with an electrical arc as the shaft is moved in said direction; and rotating the holding forces at said locations as the shaft is moved in said direction to eliminate breakaway friction between the shaft and the chamber.

* * * * *